US005346560A

United States Patent [19]

Mournet et al.

[11] Patent Number: 5,346,560

[45] Date of Patent: Sep. 13, 1994

[54] PROCESS FOR THE TREATMENT OF FERROUS METAL PARTS TO IMPROVE THEIR CORROSION RESISTANCE AND FRICTION PROPERTIES SIMULTANEOUSLY

[75] Inventors: Sylvie Mournet, Gourgois; Joseph Wawra, Saint-Just/Saint-Rambert, both of France

[73] Assignee: Centre Stephanois de Recherches Mecaniques Hydromecanique et Frottement, Andrezieux-Boutheon, France

[21] Appl. No.: 896,928

[22] Filed: Jun. 11, 1992

[30] Foreign Application Priority Data

Jul. 16, 1991 [FR] France ..... 91 08946

[51] Int. Cl.[5] ..... C23C 8/40

[52] U.S. Cl. ..... 148/217; 148/220; 148/234; 148/251

[58] Field of Search ..... 148/217, 220, 222, 228, 148/234, 235, 251

[56] References Cited

U.S. PATENT DOCUMENTS

| | | | |
|---|---|---|---|
| 4,496,401 | 1/1985 | Dawes et al. | 148/217 |
| 4,500,564 | 2/1985 | Enomoto | 148/222 |
| 4,704,168 | 11/1987 | Salik et al. | 148/222 |

FOREIGN PATENT DOCUMENTS

| | | | |
|---|---|---|---|
| 62550 | 10/1982 | European Pat. Off. | 148/222 |
| 2227755 | 8/1990 | United Kingdom | 148/220 |

*Primary Examiner*—George Wyszomierski
*Attorney, Agent, or Firm*—Young & Thompson

[57] ABSTRACT

Precision ferrous metal parts subject to severe friction and corrosion in use are nitrided, preferably in a bath of molten salts based on $CNO^-$ cyanate ions, oxidized, preferably in baths of molten oxidizing alkaline salts, and then impregnated with a hydrophobic wax. A layer after the nitriding and oxidation steps is formed of a close-packed deep sub-layer and a porous superficial sub-layer ranging in thickness between 5 and 25 μm, and exhibiting through pores ranging between 0.2 and 3 μm in diameter. The impregnation wax is an organic compound with a high molecular weight between 500 and 10,000, with a surface tension in the liquid state ranging between 10 and 73 mN/m, the contact angle between the solid phase of the superficial layer and the wax in the liquid state ranging between 0 and 75° C.

9 Claims, No Drawings

PROCESS FOR THE TREATMENT OF FERROUS METAL PARTS TO IMPROVE THEIR CORROSION RESISTANCE AND FRICTION PROPERTIES SIMULTANEOUSLY

BACKGROUND OF THE INVENTION

1. Field of the Invention

The present invention concerns a treatment process of treatment to improve the corrosion resistance and friction properties of ferrous metal parts simultaneously, and the resulting treated ferrous metal parts.

To confer both friction properties and corrosion resistance on ferrous metal parts, two distinct successive treatments are generally performed, a first treatment to give the parts the friction properties, and a second surface treatment to ensure the corrosion protection, the latter, for example, by making a deposit of zinc followed by chromating.

The friction and corrosion resistance properties acquired by these treatments are often sufficient for conventional parts.

However, for certain applications in which increasingly superior technical performance is now demanded of the parts, especially for parts subject to severe loads involving several factors simultaneously (friction, wear, especially abrasive wear, impact, corrosion), the properties conferred by conventional processes are insufficient.

This applies, for example, to parts intended for lock mechanisms, certain types of bolt and precision screw, machine screws, hinge pins, jack and shock absorber rods, and game balls or bowls. The industries concerned are in particular the automobile industry, public works, materials handlings, capital goods, home appliances and hydraulic equipment.

2. Prior art

It is known that good friction properties and good corrosion resistance can be conferred on ferrous metal parts by nitriding followed by oxidation.

This is achieved by known processes of nitriding ferrous metal parts, in particular nitriding in baths of molten cyanates and carbonates as described in French patent application 2 171 993 and French patent application 2 271 307, and nitriding in an ionized nitrogen atmosphere, which serve to improve the friction properties of these parts, by reducing the friction coefficient, and by increasing the resistance to wear and to seizure.

It is also known that if a previously nitrided part is subjected to oxidation, changes are caused in the nitrided surface and the corrosion resistance of these parts is thus improved, while preserving the friction properties acquired by nitriding. For this purpose, French patent application 2 525 637 describes a particularly effective oxidation treatment in a bath of molten oxidizing salts. Comparable results of corrosion resistance are obtained by a process of oxidation in ionized atmosphere of a gas containing oxygen.

However, this type of process confers, on the nitrided and then oxidized parts, friction properties and corrosion resistance which are insufficient for the applications mentioned.

OBJECT AND SUMMARY OF THE INVENTION

It has been discovered that these shortcomings could be overcome by supplementing the nitriding and oxidation treatments by the application of a final coating.

The present invention is also based on the finding that many parts are normally cleaned, in particular before their assembly, whereas it is well known that they do not justify such a cleaning, and for which it is therefore unnecessary to perform a surface treatment withstanding the conventional cleaning products.

According to one aspect of the present invention, there is provided a process for the treatment of ferrous metal parts to improve both corrosion resistance and friction properties of the parts including the steps of nitriding, oxidation and coating, said process comprising:

(i) conducting the nitriding and oxidation steps to form a layer comprising a close-packed deep sub-layer and a porous superficial sub-layer after the nitriding and oxidation steps, the superficial sub-layer having a thickness between 5 and 25 μm and exhibiting through pores ranging between 0.2 and 3 μm in diameter, and (ii) impregnating the oxidized parts with a hydrophobic wax, the wax being a carbonaceous organic compound with a molecular weight between 500 and 10,000, with a surface tension in the liquid state between 10 and 73 mN/m, the contact angle between the solid phase of the superficial layer and the wax in the liquid state ranging between 0 and 75°.

According to another aspect of the invention, there is provided a treated ferrous metal part having a layer comprising a close-packed deep sub-layer and a porous superficial sub-layer after the nitriding and oxidation steps, the superficial sub-layer having a thickness between 5 and 25 μm and exhibiting through pores ranging between 0.2 and 3 μm in diameter, and the porous superficial sub-layers being impregnated with hydrophobic wax, the wax being a carbonaceous organic compound with a molecular weight between 500 and 10,000, with a surface tension in the liquid state between 10 and 73 mN/m, the contact angle between the solid phase of the superficial layer and the wax in the liquid state ranging between 0 and 75°.

With respect to other characteristics, the superficial sub-layer contains more than 60% of $Fe_{2-3}N$ solid phase, exhibits a hardness between 550 and 650 HV 0.1, and a roughness between 0.3 and 1.5 μm CLA.

The impregnation wax is selected from the list: natural waxes, or synthetic polyethylene, polypropylene, polyester, fluorinated waxes, or paraffin wax.

The process according to the invention offers the advantages of being inexpensive and easy to implement, even for industrial production series parts, of conferring high technical performance on the treated parts, even if they are of complex shape.

Moreover, the protective effects of a surface treated by this process with respect to ageing by friction, by abrasive wear, by impact and by wet corrosion are increased in astonishing proportions in comparison with the solutions routinely used, and help to resist these forms of deterioration for a long time. These results will be developed further in examples.

The composition of the nitrided layer, its thickness and its hardness are adjusted so that it resists wear, without necessarily being brittle, because, in that case, it would spall under the effect of repeated impact. The close-packed hexagonal structure of the $Fe_{2-3}N$ phase of the iron/nitrogen equilibrium diagram offers a good deformation capacity, thanks to a high atomic density on the cleavage plane, and is thus ideal for friction applications.

For the combination of surface roughness, molecular weight and surface tension of the wax, and contact angle between the solid phase and the liquid phase, the intervals indicated are those that lead to maximum effectiveness of wax impregnation, since, in these conditions, the wax can only be removed in extreme, hence highly unusual and, at all events, exceptional conditions for the intended applications.

Experiments have also demonstrated that improved corrosion resistance is not the only benefit of the wax, because the latter applied to another surface, even known to favor the adhesion of organic compounds, only leads to a much lower corrosion resistance.

Conversely, the absence of wax decreases the effectiveness of nitriding, both from the standpoint of friction properties and from that of impact strength, since the wax tends to minimize the rebound effects.

In a particularly interesting arrangement of the invention, the nitriding is performed in a bath of molten salts as in French patent application 2 171 993, consisting essentially of carbonates and cyanates of alkaline metals K, Na and Li, the anion $CO_3^{2-}$being present in 1 to 35% by weight, and the anion $CNO^-$in 35 to 65% by weight, whereas, in the total weight of the alkaline cations, the weight proportions are 25 to 42.6% for $Na^+$, 42.6 to 62.5% for $K^+$, and 11.3 to 17.1% for $Li^+$.

Even better, the bath of nitriding salt also includes a sulfur compound in a quantity such that the weight content of elemental sulfur is between 0.001 and 1%, as in French patent application 2 271 307.

This makes it possible to control accurately the formation of the superficial sub-layer saturated due to the diffusion of the hetero-element, and to favor the appearance of the $Fe_{2-3}N$ phase of the iron/nitrogen equilibrium diagram in significant proportions, higher than 60%.

The oxidation treatment, besides already improving the corrosion resistance, if also correctly controlled, serves to adjust the surface properties of the solid phase ideally, to achieve maximum effectiveness of wax impregnation.

The inventors have excellent reasons for believing that the presence in the combination layer of a strong electron donor or acceptor element capable of creating electric dipoles locally is a significant asset. In this case, in fact, chemical bonding forces are created, which locally strengthen the capillary forces. To achieve this, the presence of sulfur as well as oxygen is privileged in the superficial sub-layer.

According to the preferred arrangements, the oxidation is performed in a bath of molten salts as in French patent application 2 525 637, generally at temperatures ranging between 350° and 450° C.

The characteristics and other advantages of the invention will emerge better from the description which follows, illustrated by experimental examples.

DETAILED DESCRIPTION OF PREFERRED MODES

EXAMPLE 1

Use was made of test specimens combinations comprising a ring 35 mm in diameter and a plate measuring 30×18 ×8 mm, of XC 38 steel.

These samples were nitrided in a bath of molten salts, containing carbonates and cyanates of sodium, potassium and lithium as in French patent application 2 171 993 and French patent application 2 271 307, with 37% by weight of $CNO^-$cyanate ions and about 10 ppm of $S^{2-}$ions, the bath temperature being 570±15° C. and the immersion time of the parts being 90 min.

By weight composition, the sulfur nitrided layer contains about 87% iron ϵ nitride ($Fe_{2-3}N$) about 10% γ′ nitride ($Fe_4N$), the remainder consisting of iron oxides, sulfides and oxysulfides. Its hardness is 600 HV 0.1.

Structurally, the sulfonitrided layer exhibits a thickness of 15 μm with a close-packed deep sub-layer 8 μm thick and a porous superficial sub-layer 7 μm thick, the pore diameter ranging between 1 and 2.5 μm, with most being in the range 1.5 to 2 μm.

On leaving the nitriding bath, the parts are immersed for 20 min in an oxidation salt bath as in French patent application 2 525 637, at a temperature of 420±15° C.

After this treatment, the nitrided layer of the parts comprises ϵ nitride with 6% γ′ nitride, whereas all the oxysulfide compounds have been converted to magnetite iron oxide ($Fe_3O_4$) with oxygen inserted in the first two to three superficial microns.

The surface roughness is 0.6 μ CLA.

The corrosion resistance in standard salt mist is 50 to 60 h for the nitrided parts, and 200 to 250 h for the nitrided then oxidized parts, whereas the parts before treatment exhibit generalized corrosion after a few hours only.

In a friction test, in which a rotating ring bears against a rectangular plate with a load increasing linearly from its initial value of 10 dan and at a sliding rate of 0.55 m/s, the test time reaches 30 min for the nitrided parts, with a cumulative wear of the two parts of 50 μm and a friction coefficient of 0.40. With the nitrided then oxidized parts, these figures change respectively to 45 min test time, 40 μm cumulative wear, and 0.30 friction coefficient.

Impregnation is performed on the parts thus nitrided then oxidized, by immersing them for 2 min in melted polyethylene wax at a temperature of 150 ° C. On leaving the molten wax bath, the parts are wiped with a clean, dry cloth.

The surface tension of the viscous phase is 32 mN/m and the contact angle between the solid phase, here the sulfonitrided then oxidized layer, and the viscous phase is 41°.

The corrosion resistance exceeds 2000 h, whereas the friction test can be continued for 50 min, for a cumulative wear of only 25 μm and a friction coefficient of 0.18.

Experiments of the same type were conducted on parts which were nitrided either by the gaseous method in ammonia atmosphere, or by the ionic method in nitrogen atmosphere. Comparable results were obtained.

Similarly, by performing a thermochemical nitrocarburizing treatment in nitride/carbon medium, for example in a salt bath or by the gaseous method, subject however to limiting the carbon embrittlement effect, which is limited in practice to 3% in the superficial diffusion layer.

It was also confirmed that oxidation subsequent to the thermochemical treatment can be performed, not only in a salt bath, but by a simple or ionized gaseous method.

The final coating can also be performed by immersion of the parts, not in a bath of molten wax, but in a solvent containing said wax in the dissolved state.

A series of examples are given below of the application of the invention to prototype parts representative of industrial reality.

EXAMPLE 2

Nitriding was performed on automobile lock parts of complex shape, of stamped, punched, bent sheet metal, according to the conditions described in French patent applications 2 171 993 and 2 271 307. On leaving the nitriding treatment, the parts have undergone oxidation treatment in the conditions described by French patent application 2 525 637. A wax impregnation was also carried out using a sulfonate paraffin wax type, by immersing the parts in said wax dissolved at the rate of 70 g/liter in white spirits.

Thus conditioned, the parts meet all the specifications set by automobile manufacturers, and, in particular, corrosion resistance to salt mist of at least 200 h without 'white rust' and at least 400 h without 'red rust' the parts having been subjected, before exposure to the salt mist, to storing for 1 h at a temperature of 120° C.

It may be observed that the solution routinely used so far for this type of application, which consists of a deposit of zinc or zinc/nickel alloy followed by chromating, does not meet the foregoing specifications.

At the same time as the corrosion resistance of the parts is improved, very gentle operation and the absence of wear is observed in the locks, even after several tens of door opening/closing operations, some of them performed with sufficient abruptness to generate overstress and impact effects.

EXAMPLE 3

In the same conditions as in Example 2, windscreen wiper shafts were treated, supports of the oscillating wipers, and made of carbon steel.

The same corrosion resistance specifications as in Example 1 were also met here, and the friction against sintered rings impregnated with oil occurs in very satisfactory conditions.

The reference solution used so far, which was the deposit of electrolytic nickel, presented two drawbacks: insufficient corrosion resistance and the existence of extra-thick deposits on the sharp edges, which were detrimental to the assembly of the parts.

EXAMPLE 4

Still in the same conditions as in the foregoing examples, self-tapping screws of 20 CDV 5 steel were treated, designed for drilling in 30 mm of wood followed by 6 mm of steel with self-tapping of the steel.

In comparison with the conventional carburizing-/quench/zinc electroplating, a significant decrease was observed in the friction coefficient, a substantial improvement in wear resistance, and a clear increase in corrosion resistance, not only of the visible parts of the screw after assembly, that is to say the head and projecting end, but also of the threaded parts in contact with the wood and with the steel.

EXAMPLE 5

This example concerns hinge pins such as those found on elevator tailgates such as truck elevators, or fork-lift trucks, made of 35 CD 4 steel.

In comparison with the conventional solution employing quench/annealing heat treatment followed by bichromate galvanization, a significant improvement is found in the friction coefficient and very good corrosion resistance in dynamic operation of the hinge, without any risk of hydrogen embrittlement of the parts.

EXAMPLE 6

The process of the invention is applied to game balls or bowls, in particular for the French game "pétanque" better known as bocci balls or bowls. These balls or bowls are formed of two hemispherical cups of alloy steel type 25 CD 4, welded along a diametral plane. After grinding to gauge, they are heat-treated to exhibit a specified hardness in the mass, of at least 110 daN/mm$^2$. They then undergo the same surface conditioning as in the four preceding examples.

Thus prepared, the balls or bowls exhibit a set of characteristics, friction coefficients and surface regularity which, in the opinion of specialists, are extremely popular with top-level players, participating in official championships and competitions. These are in particular: very good corrosion resistance, very low wear guaranteeing compliance with the regulations, which state that the weight loss due to play must not exceed 15 g below the marked weight, ability to withstand impact without damage, and attractive appearance of a shiny black color.

It is clear that, in this type of application, the final waxing can be kept up by the player himself.

What we claim is:

1. Process for the treatment of ferrous metal parts to improve both corrosion resistance and friction properties of the parts including the steps of nitriding, oxidation and wax coating, said process comprising:

(i) performing the nitriding step in a bath of molten salts consisting essentially of carbonates and cyanates of alkaline metals k, Na and Li, $CO_3^{2-}$anions being present in 1 to 35% by weight and $CNO^-$anions in 35 to 65% by weight of the total weight of the bath whereas in the total weight of alkaline cations, the weight proportions are 25 to 42.6% for $Na^+$, 42.6 to 62.5% for $K^+$and 11.3 to 17.1% for $Li^+$, the nitriding being carried out to result in the formation of a layer comprising a) a close-packed deep sublayer and b) a porous superficial sub-layer, the superficial sub-layer having a thickness between 5 and 25 μm and exhibiting pores ranging between 0.2 and 3 μm in diameter, (ii) carrying out the oxidation step in a bath of molten oxidizing alkaline salts at a temperature ranging between about 350 and 450° C., and (iii) impregnating the porous superficial sub-layer with a hydrophobic wax, the wax being a carbonaceous organic compound with a molecular weight between 500 and 10,000, with a surface tension in the liquid state between 10 and 73 mN/m, the contact angle between the solid phase of the superficial layer and the wax in the liquid state ranging between 0 and 75°.

2. Process as claimed in claim 1, wherein the superficial sub-layer contains more than 60% of solid phase $Fe_{2-3}N$, and has a hardness between 550 and 650 HV 0.1, and a roughness ranging between 0.3 and 1.5 μ CLA.

3. Process as claimed in claim 1, wherein the nitriding is carried out in the presence of a quantity of carbonaceous compounds selected in order to obtain a carbon content less than 3% in the superficial sub-layer.

4. Process as claimed in claim 1, wherein the bath of molten salts includes a sulfur compound so that a chemical sulfiding reaction is carried out simultaneously with the nitriding step.

5. Process as claimed in claim 1, wherein the wax impregnating step is carried out by immersion of the parts in molten wax.

6. Process as claimed in claim 1, wherein the wax impregnating step is carried out by immersing the parts in a solution of wax dissolved in a solvent.

7. Process as claimed in claim 1, wherein the wax is selected from the group consisting of natural waxes and synthetic waxes.

8. Process as claimed in claim 7, wherein the wax is a synthetic wax selected from the group consisting of fluorinated, polyethylene, polypropylene and polyester waxes.

9. Process as claimed in claim 1, wherein the hydrophobic wax is a paraffin wax.

* * * * *